United States Patent [19]

Tobolski

[11] 4,102,555

[45] Jul. 25, 1978

[54] FOLDING WORK TABLE APPARATUS

[76] Inventor: Thaddeus Tobolski, 731 N. 115th St., Wauwatosa, Wis. 53226

[21] Appl. No.: 763,864

[22] Filed: Jan. 31, 1977

[51] Int. Cl.[2] ..... A47B 3/00; E04G 1/34

[52] U.S. Cl. ..... 312/240; 312/241; 182/155; 108/111

[58] Field of Search ..... 312/240, 241; 182/155, 182/152; 108/111, 129

[56] References Cited

U.S. PATENT DOCUMENTS

| | | | |
|---|---|---|---|
| Re. 26,354 | 2/1968 | Usher et al. | 182/152 |
| 1,198,431 | 9/1916 | Forsyth | 108/111 |
| 2,272,957 | 2/1942 | Walp | 182/155 |
| 2,445,286 | 7/1948 | Weislander | 182/155 |
| 2,522,296 | 9/1950 | Overstedt | 108/129 |
| 3,016,104 | 1/1962 | Johnson | 182/155 |
| 3,212,605 | 10/1965 | Dickerson | 182/152 |
| 3,235,038 | 2/1966 | Nesslinger | 182/152 |
| 3,498,412 | 3/1970 | Best | 182/152 |

FOREIGN PATENT DOCUMENTS

| | | | |
|---|---|---|---|
| 635,681 | 3/1928 | France | 108/111 |
| 89,645 | 7/1937 | Sweden | 108/111 |
| 445,091 | 2/1968 | Switzerland | 182/152 |

*Primary Examiner*—Paul R. Gilliam
*Assistant Examiner*—Victor N. Sakran
*Attorney, Agent, or Firm*—Andrus, Sceales, Starke & Sawall

[57] ABSTRACT

A work table has first and second spaced leg assemblies with a table pivotally secured to the first leg assembly for vertical storage positioning against the first leg assembly and a horizontal work position with a free outer end resting on the leg assembly. A two-piece flat shelf has a first member hinged to the first leg assembly, a second member hinged to the second leg assembly. The shelf members having abutting inner edges with a releasable clamp unit connecting the inner edges. A V-shaped stabilizer unit includes a first and second brace member with a top end secured to the tops of the leg assemblies and a bottom end secured to the shelf members. The brace members may be connected to the shelf members and collapsible, or may be pivotally connected to each other and releasably connected to the shelf members for folding to a storage position, with the table abutting the first leg assembly and the shelf members abutting the leg assemblies.

8 Claims, 11 Drawing Figures

Fig. 3
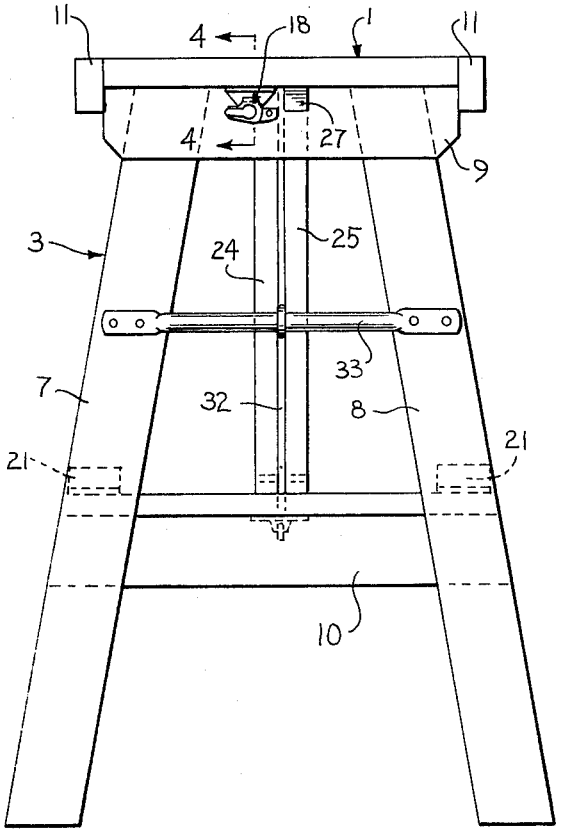
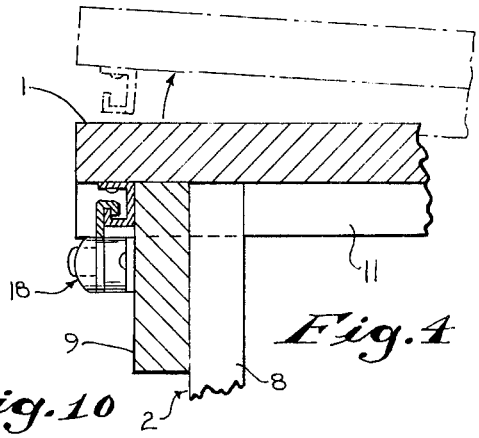
Fig. 4
Fig. 10
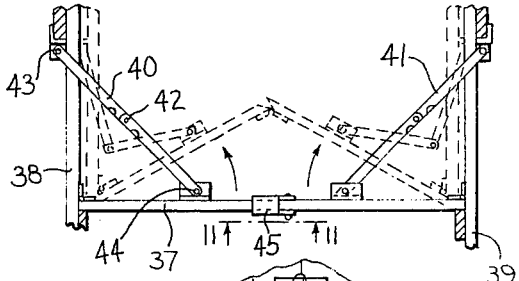
Fig. 11
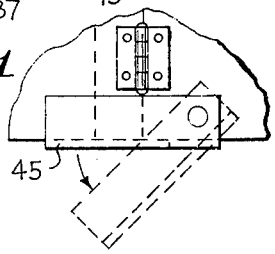
Fig. 9
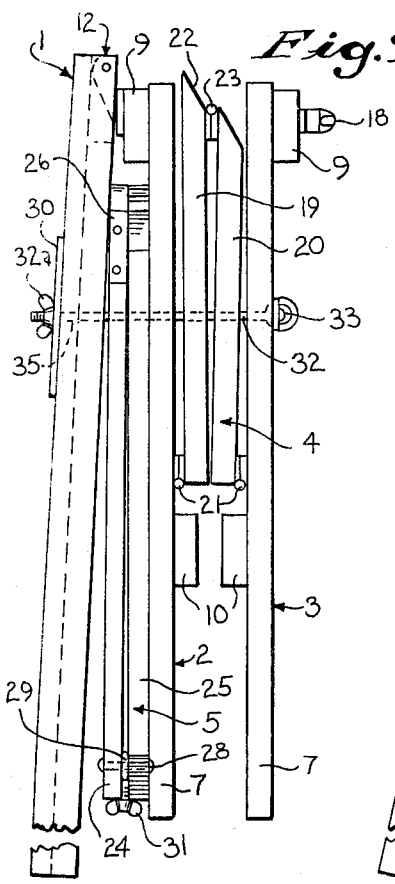
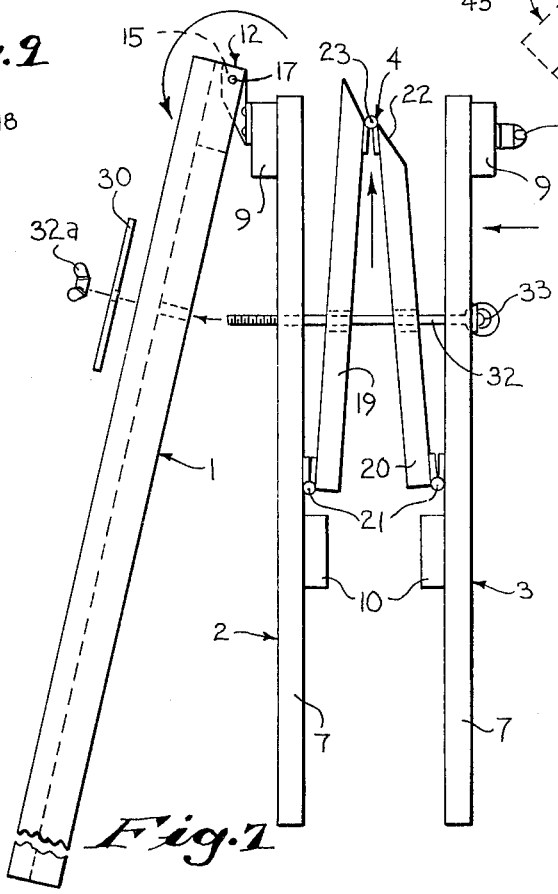
Fig. 7
Fig. 8
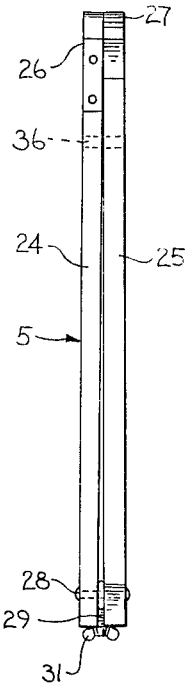

FOLDING WORK TABLE APPARATUS

BACKGROUND OF THE INVENTION

This invention relates to a collapsible work table providing spaced working and support surfaces and foldable to a compact storage assembly.

Portable work tables have been suggested including foldable or collapsible constructions. Such device generally include a suitable upper working surface with leg structures interconnected by suitable hinged connections to permit the folding for storage, transportation, and the like. Generally such devices merely provide an upper working surface and do not provide auxiliary understructures for convenient storage of equipment such as tools and the like. Where additional working or supporting surfaces are employed, complex interconnections have generally been provided. A multiple shelf working table apparatus which is of a simple, economical and sturdy construction would provide significant advance in the art.

SUMMARY OF THE PRESENT INVENTION

The present invention is particularly directed to a collapsible work table providing an upper working surface and at least one intermediate supporting auxiliary surface interconnected to a supporting leg structure by suitable collapsible and folding connections to permit folding into a compact assembly for transport, storage and the like.

Generally in accordance with the present invention, an upper surface member is hingedly secured to one of a pair of spaced end leg structures. The upper surface member is pivotal to lie adjacent to and abutting the end leg structures in a collapsed position and pivoted to 270° to a horizontal position with the opposite or free end supported by the opposite leg structure. The leg structures are also interconnected to each other by an intermediate support member hingedly secured to the structures at the adjacent ends. The central portion of the auxiliary support member is further provided with an intermediate connecting hinge, permitting the folding of the central support and folding of the outer leg structure to the inner leg structure. To provide a firm construction, an auxiliary supporting structure is provided and secured to the central portion of the intermediate support structure and to the two outer support structures. The auxiliary support structure is released to permit collapse and folding of the table. The top and intermediate support surfaces are rectangular table members. The intermediate member has interconnecting hinge supports permitting the folding of the opposite halves thereof into abutting engagement.

An intermediate V-shaped cross brace assembly includes similar members pivotally secured to each other at a central position and extending upwardly in a V-shape therefrom with an opposite outer end releasably attached to the upper cross braces of the first and second leg structures. In the folded position, the central shelf or table fits between the two leg structures immediately above the cross braces and the collapsed leg structure and the table top abuts the one leg structure with the total assembly interconnected for convenient storage, carrying, transportation and the like.

This invention thus provides a simple, reliable and multi-shelved surface work table and is an economical construction while providing convenient storage when not in use.

BRIEF DESCRIPTION OF THE DRAWINGS

The drawings furnished herewith illustrate a preferred construction of the present invention in which the above advantages and features are clearly disclosed as well as others which will be readily understood from the following description.

In the drawings:

FIG. 3 is a side view of the table assembly shown in FIGS. 1 and 2;

FIG. 4 is an enlarged view of a table top latch unit taken on the line 4—4 of FIG. 3;

FIG. 7 is a view showing the table in a partially folded position;

FIG. 8 is a view of a brace structure;

FIG. 9 is a view of the table in the folded position;

FIG. 10 is a fragmentary view of an alternate table construction showing a collapsing linkage in a partially collapsed position; and FIG. 11 is a fragmentary view taken generally on line 11—11 of FIG. 10.

DESCRIPTION OF THE ILLUSTRATED EMBODIMENT

Figure 1:
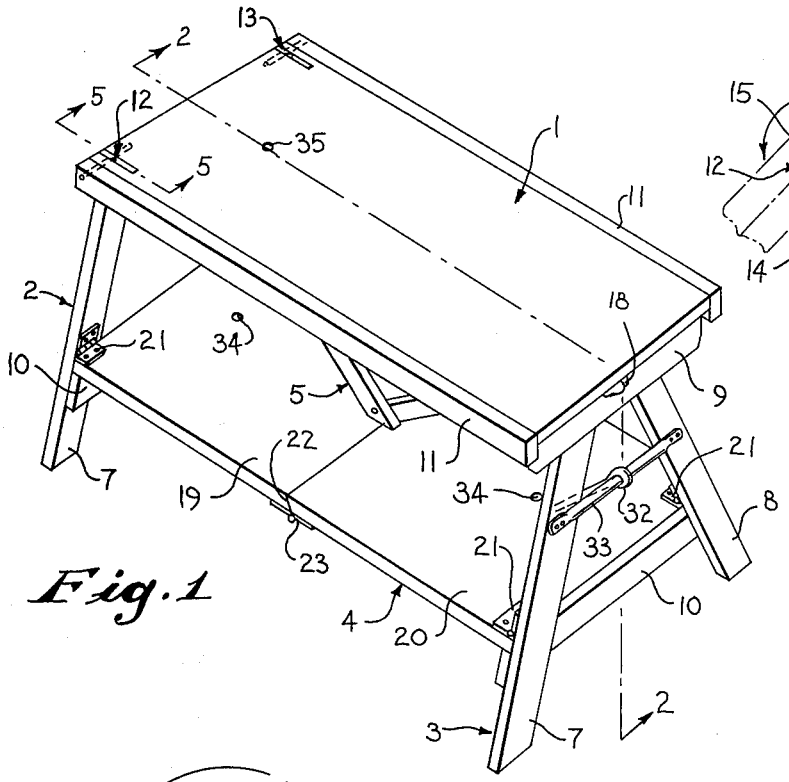
FIG. 1 is a pictorial view of the work table in the working position.
Figure 2:
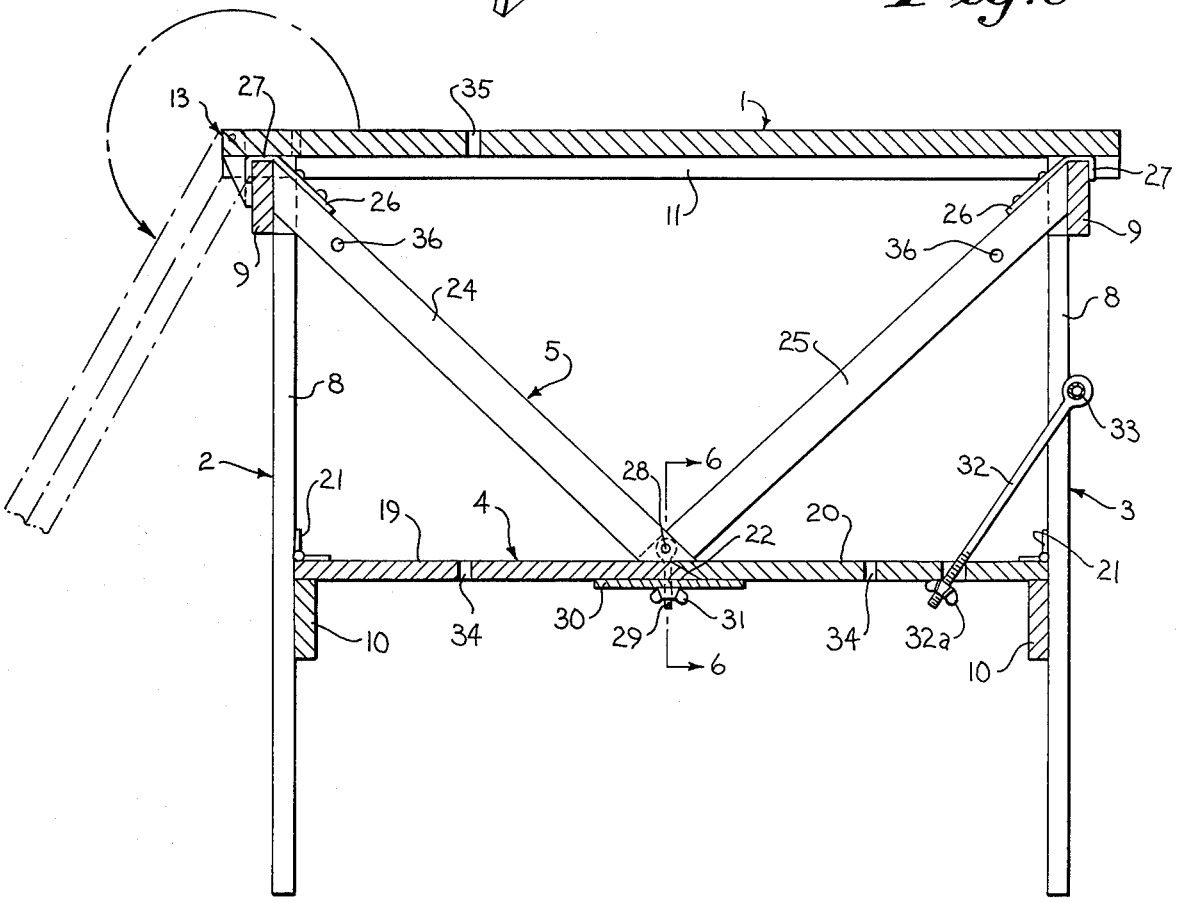
FIG. 2 is a vertical longitudinal section of the working table taken on line 2—2 of FIG. 1.

Referring to the drawings and particularly to FIGS. 1-3, a folding table is illustrated having a flat rectangular table top 1 supported at the opposite ends by first and second similar leg structures 2 and 3. An intermediate two-piece shelf 4 is interconnected to the leg structures in downwardly parallel spaced relation to the table top 1. A V-shaped cross brace unit 5 has its central apex secured to the intermediate shelf 4 with the first and extending upwardly and outwardly therefrom with the ends connected to the upper ends of the legs 2 and 3. Thus, in assembled relation, the work table provides an upper work surface 1 as well as an auxiliary storage surface or shelf 4. The total assembly is firmly interconnected through the end legs 2 and 3, the members 1 and 4 and the cross bracing unit 5 to form a stable, reliable work support. The total assembly as presently developed, is adapted to be conveniently folded into a compact assembly as shown in FIG. 9. When folded, the table top 1 extends downwardly along one side of the collapsed legs. The legs 2 and 3 are in closed-spaced relation and with the central shelf 4 folded therebetween. The total assembly is interconnected for storage convenience.

More particularly, in the illustrated embodiment of the invention, the first and second legs 2 and 3 are similarly constructed and reference is made to the first leg 2 for purposes of description.

The leg 2 includes a pair of laterally spaced wooden leg members 7 and 8. The upper ends of the members are interconnected by a lateral cross plate brace 9 secured to the exterior side of the leg members as by nailing, bolting and the like. A central cross plate brace 10 is located to the interior side of the leg members immediately below the intermediate shelf 4.

The table top 1 is generally a rectangular member having a lip or edge 11 secured along the long sides of the table top 1. The width of the table structure between the proposed ledges or lips 11 generally corresponds to the width of the cross brace 9.

Figure 5:
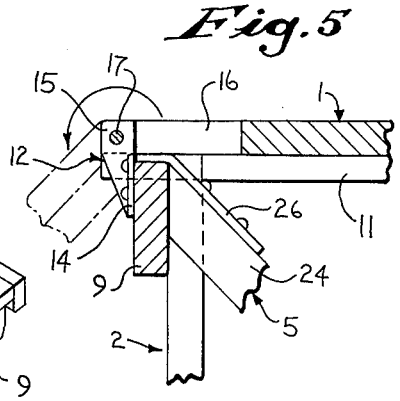
FIG. 5 is an enlarged view of a table top hinge unit taken on line 5—5 of FIG. 1.

The one end of table top 1 is hinged to the upper cross brace 9 by a pair of similar hinge units 12 and 13 at the upper end of each of the leg members 7 and 8. As shown most clearly in FIG. 5, the hinge 12 includes a first hinge plate 14 firmly attached to the top cross brace 9 as by bolting, screwing or the like. The hinge plate 14 includes a leaf 15 at right angles to plate 14 and the leaf 15 projects upwardly into a slot 16 in the end of table top 1. A pin 17 is embedded in the table top 1 and extends through an opening in the upper end of the leaf 15 to pivotally support table top 1. The slot 16 is elongated and extends into table top 1 such that the table top can be pivoted 270° from the horizontal position to abut the exterior of leg 2. The hinge leaf 15 is received in the slot 16. In the work position, the opposite end of the table top 1 rests upon and is supported by leg 3. A pivot-type window latch 18 is shown to releasably clamp the table top in the work position, as shown in FIG. 4.

The intermediate shelf unit 4 is interconnected to legs 2 and 3 and to the cross brace unit 4 to form a rigid understructure support for the table top unit 1. In particular, the shelf unit 4 is formed as a split member including a first flat shelf element or member 19 and a second similar flat shelf element or member 20. The members 19 and 20 are hingedly attached to the leg members 7 and 8 immediately above the cross braces 10.

Figure 6:
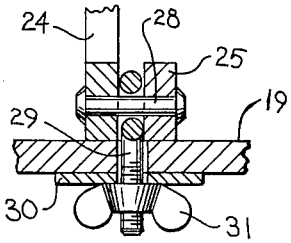
FIG. 6 is an enlarged view of a connection taken on line 6—6 of FIG. 2.

In the illustrated embodiment of the invention, a simple leaf hinge 21 interconnects each of the members 19 and 20 to the corresponding legs 7 and 8 immediately above the brace 10 and permit the upward folding of the member toward the adjacent leg, as shown in FIGS. 7 and 8. The members 19 and 20 are formed with an angled or inclined overlapped edge 22 which is located slightly off-center. The members 19 and 20 are similarly interconnected at the opposite sides thereof by suitable flat hinges 23 to legs 2 and 3. With the cross brace unit 5 removed and the table top 1 pivoted to the collapse position, the intermediate shelf unit 4 can be collapsed or folded upwardly as shown in FIGS. 6 and 7.

The cross brace unit 5 includes similar rigid braces or members 24 and 25. Referring to member 24, the upper end is provided with a supporting hook unit 26 which is bolted or otherwise secured to the upper edge of the member and includes a top hook 27 located resting over the top cross brace 9 of legs 2 and 3. Member 25 includes a similar hook unit 26. The ends of the members 24 and 25 are cut to abut the inner face of the cross braces 9. The lower ends of the members 24 and 25 are cut to lie or abut the planar face defined by the intermediate shelf unit 4. The lower ends of the members 24 and 25 also overlap and are interconnected by a connecting bolt or pivot pin 28. An eye bolt 29 is located on the pivot pin 28 between members 24 and 25 and extends downwardly through an appropriate opening in the shelf member 19 to the one side of the edge 22, which as previously noted is formed slightly off center. A clamp plate 30 is secured abutting the opposite face of the shelf unit 4 and extends across the separating edges 22. A clamping wing nut 31 is secured to the eye bolt 29 and firmly clamps the shelf unit 4 between the lower ends of the members 24 and 25 and the clamp plate 30. The clamp plate 30 can be made of any desired width to provide desired structural strength to the intermediate shelf unit 4. The assembly provides a sturdy work table which can be readily disassembled by merely releasing of the table top 1 and folding it backwardly against the leg 2, removing wing nut 31 and brace unit 5. The shelf 4 is folded upwardly, with the leg 3 moving laterally into abutting engagement as shown in FIGS. 7 and 8. The cross brace unit 5 is folded as shown in FIG. 8 and located between the folded table top 1 and the adjacent leg 2.

An eye bolt 32 is shown for interconnecting of the collapsed assembly. In the illustrated embodiment of the invention, an eye bolt 32 is pivotally mounted on a cross bar 33 secured to members 7 and 8 of the leg 3. In assembled relation, the bolt 32 extends downwardly through an appropriate opening in the shelf member 20 with a wing nut 32a locking it in place. This stores the unit and may serve to strengthen the assembly. The shelf members 19 and 20 and table top 1 are provided with suitable openings 34 and 35 such that during the collapsing, the bolt 32 can be moved upwardly and transferred through the openings as illustrated in FIGS. 7 and 8. The separate folded members 24 and 25 of brace unit 5 similarly include openings 36 to allow complete interconnection of the folded assembly. This provides a very convenient compact assembly for storage.

Although the supporting brace structure is shown as a completely removable assembly which can be readily provided and constructed, an integrated support structure employing a hinged member may be provided, for example, as shown in FIGS. 10 and 11. In FIG. 10, a split intermediate shelf unit 37 is similarly provided and interconnected to opposed end leg structures 38 and 39. The table top, not shown, would be formed and attached as shown in the previous embodiment.

In the embodiment of FIGS. 10 and 11, brace members 40 and 41 are provided for the opposite halves of the split shelf 37. Each is similarly connected as shown in FIG. 10. Thus, referring to member 40, a pair of metal strips are pivotally connected at the center by a pin 42 and pivotally secured at the opposite end to the underside of the top cross brace 43 and to a pivot support 44 on shelf 37. The opposite halves of shelf unit 37 are rigidly held in the extended position by a simple channel clamp 45 pivotally secured to half of shelf 37 and pivotal into overlying engagement with the overlapping edges of the shelf members and pivotal outwardly to release the members, as shown in FIG. 11. Thus, when it is desired to collapse the assembly, the clamp 45 is pivoted outwardly to release the split shelf member 37 at the hinges and braces 40 and 41 are collapsed upwardly, pulling the shelf members upwardly. The shelf members are hinged and interconnected to fold as shown in FIG. 10.

The present invention provides a simple, reliable and relatively low cost construction for a folding work table. Various modes of carrying out the invention are contemplated as being within the scope of the following claims particularly pointing out and distinctly claiming the subject matter which is regarded as the invention.

I claim:

1. A folding work table apparatus comprising a pair of laterally spaced first and second vertical leg assemblies having laterally spaced supporting leg members, a rectangular top work table abutting the top of the leg assemblies in a supported work position, said table and leg assemblies having a similar length, a hinge means connected to said table and to said first leg assembly for pivotal movement of said table through 270° from said work position to a storage position abutting the exterior of said first leg assembly, an intermediate shelf structure having a first flat shelf element and a second flat shelf element, first and second hinge means fixedly connected one each to each of said first and second shelf elements and said first and second leg assemblies and having a releasable center connection means firmly supporting the elements in generally coplanar relation and including a movable element to release the connection means for permitting folding of the shelf elements into abutting engagement with the leg members of the leg assemblies, and a pair of stabilizing members one for each of said first and second elements, each member connected to the one of the leg assemblies immediately adjacent the element and to one of the elements of the intermediate shelf structure for firmly supporting the elements, said stabilizing members including release means for permitting said folding of the intermediate shelf structure and positioning of the leg assemblies into an adjacent storage relationship with the shelf elements located between the leg members.

2. The work table apparatus of claim 1 wherein said stabilizing members are releasable attached to the upper ends of the leg assemblies and having the lower ends pivotally connected to the shelf elements and at the releasable connection means.

3. The folding table apparatus of claim 1 wherein the stabilizing members include first and second rigid braces having a pivotal connection pivotally interconnecting the braces at the shelf structure and extending angularly upwardly therefrom, clamp means secured to said pivotal connection and to said first and second elements to secure the braces to the elements and to connect the elements to each other and thereby defining said releasable connection means, each of said braces having a top hook means hooked over a top portion of one of the leg assemblies, and hinge means connecting the inner ends of the first and second elements.

4. The folding table apparatus of claim 1 wherein said stabilizing members include a first brace pivotally connected to the first leg assembly and to the first element of the shelf structure and having a central releasable pivot connection for folding of the brace and first element, a second brace pivotally connected to the second leg assembly and to the second element and having a central releasable pivot connection for folding of the second brace and second element, and said releasable connection means include a releasable clamp means pivotally connected to the inner end of one of said elements and releasably engaging the other of said elements.

5. The folding table apparatus of claim 1 wherein said leg assemblies each include a pair of leg members connected at the top by a top cross brace and at an intermediate position by an intermediate cross brace, a pair of hinge members secured to the top cross brace and having an upstanding pivot bracket, said table having one end slotted and mating with said brackets, pin means extending through the table and brackets to pivotally support the table for said pivotal positioning between said work position and said storage position, said intermediate support structure being a two-piece flat shelf separated generally centrally thereof from first and second shelf members, hinge means securing the first and second shelf members to the leg members with the shelf members supported on the intermediate cross brace.

6. The folding table apparatus of claim 5 wherein the stabilizing members include first and second rigid braces having overlapping lower ends and having a pivotal connection at the lower end pivotally interconnecting the braces at the support shelf structure and extending angularly upwardly therefrom, bolt means secured to the pivotal connection and extending down through the first of said shelf members, a clamp bracket secured to the bolt means and extending beneath the first and second shelf members to support said members, each of said braces having a top hook means hooked over a top portion of one of the leg assemblies, and hinge means connecting the inner ends of the first and second shelf members.

7. The folding table apparatus of claim 5 wherein said stabilizing members include a first brace pivotally connected to the first leg assembly and to the first shelf member and having a central releasable pivot connection for folding of the brace and first shelf member, a second brace pivotally connected to the second leg assembly and to the second shelf member and having a central releasable pivot connection for folding of the second brace and second shelf member, and a releasable clamp channel pivotally connected to the inner end of one of said shelf members and releasably engaging the edge of the other of said shelf members.

8. A folding work table apparatus comprising a pair of laterally spaced vertical leg assemblies, each leg assembly including a pair of laterally spaced leg members interconnected by a top cross brace and an intermediate cross brace, a rectangular top table abutting the upper end of the leg assemblies in a supported work position, a hinge means connected to said table and to the top cross brace of said first leg assembly for pivotal movement from said work position through essentially 270° to a storage position abutting the first leg assembly, an intermediate rectangular table having first and second table members hinged to each of said leg members, said first and second members having abutting edges, and a releasable center connection permitting folding of the first and second members, and a pair of stabilizing members connected one each to the upper end of the leg assemblies and to the adjacent first and second members of the intermediate table, said stabilizing members including means for permitting collapsing of the intermediate table and placing of the leg assemblies into an adjacent relationship, said intermediate table including a hinge means connecting said first and second members at said abutting edges, and said stabilizing members are releasably connected to the leg assemblies, a pin means pivotally connecting the lower ends of the stabilizing members, a releasable clamp means connected to said lower ends of the stabilizing means and to the abutting edges of the table members to interconnect the stabilizing and table members into a firm support assembly.

* * * * *

UNITED STATES PATENT AND TRADEMARK OFFICE

CERTIFICATE OF CORRECTION

PATENT NO. : 4,102,555

DATED : July 25, 1978

INVENTOR(S) : THADDEUS TOBOLSKI

It is certified that error appears in the above-identified patent and that said Letters Patent are hereby corrected as shown below:

| | | | | |
|---|---|---|---|---|
| Column | 1, | Line | 9, | after "Such" cancel "device" and insert --- devices ---; |
| Column | 3, | Line | 33, | after "and" cancel "permit" and insert --- permits ---; |
| Column CLAIM 1 | 5, | Line | 11, | before "member" insert --- stabilizing ---; |
| Column CLAIM 2 | 5, | Line | 21, | before "attached" cancel "releasable" and insert --- releasably ---; |
| Column CLAIM 5 | 5, | Line | 61, | after "thereof" cancel "from" and insert --- to form said ---; |
| Column CLAIM 5 | 6, | Line | 1, | after "shelf" cancel "members" and insert --- elements ---; |
| Column CLAIM 5 | 6, | Line | 2, | after "shelf" cancel "members" and insert --- elements ---; |
| Column CLAIM 5 | 6, | Line | 3, | after "shelf" cancel "members" and insert --- elements ---; |
| Column CLAIM 6 | 6, | Line | 12, | after "shelf" cancel "members" and insert --- elements ---; |

UNITED STATES PATENT AND TRADEMARK OFFICE

CERTIFICATE OF CORRECTION

PATENT NO. : 4,102,555

DATED : July 25, 1978

INVENTOR(S) : THADDEUS TOBOLSKI

It is certified that error appears in the above-identified patent and that said Letters Patent are hereby corrected as shown below:

continued----

| | | | | |
|---|---|---|---|---|
| Column CLAIM 6 | 6, | Line | 14, | after "shelf" cancel "members" and insert --- elements ---; and after "said" cancel "members" and insert --- elements ---; |
| Column CLAIM 6 | 6, | Line | 18, | after "shelf" cancel "members" and insert --- elements ---; |
| Column CLAIM 7 | 6, | Line | 22, | at the beginning of the line, cancel "member" and insert --- element ---; |
| Column CLAIM 7 | 6, | Line | 23, | after "shelf" cancel "member" and insert --- element ---; |
| Column CLAIM 7 | 6, | Line | 25, | after "shelf" cancel "member" and insert --- element ---; |
| Column CLAIM 7 | 6, | Line | 27, | after "shelf" cancel "member" and insert --- element ---; |
| Column CLAIM 7 | 6, | Line | 29, | after "shelf" cancel "members" and insert --- elements ---; |
| Column | 6, | Line | 30, | after "shelf" cancel "members" and insert --- elements ---; |

UNITED STATES PATENT AND TRADEMARK OFFICE

CERTIFICATE OF CORRECTION

PATENT NO. : 4,102,555

DATED : July 25, 1978

INVENTOR(S) : THADDEUS TOBOLSKI

It is certified that error appears in the above-identified patent and that said Letters Patent are hereby corrected as shown below:

continued---

| | | | | |
|---|---|---|---|---|
| Column CLAIM 8 | 6, | Line | 44, | before "members" insert --- table ---; |
| Column CLAIM 8 | 6, | Line | 46, | before "members" insert --- table ---; |
| Column CLAIM 8 | 6, | Line | 53, | before "members" insert --- table ---. |

Signed and Sealed this

*Third* Day of *April 1979*

[SEAL]

*Attest:*

RUTH C. MASON
*Attesting Officer*

DONALD W. BANNER
*Commissioner of Patents and Trademarks*